US010704238B2

(12) United States Patent
Schaad

(10) Patent No.: US 10,704,238 B2
(45) Date of Patent: Jul. 7, 2020

(54) PERPETUAL FLOW FAUCET ASSEMBLY

(71) Applicant: William Schaad, Morrison, CO (US)

(72) Inventor: William Schaad, Morrison, CO (US)

( * ) Notice: Subject to any disclaimer, the term of this patent is extended or adjusted under 35 U.S.C. 154(b) by 0 days.

(21) Appl. No.: 16/122,343

(22) Filed: Sep. 5, 2018

(65) Prior Publication Data

US 2020/0071918 A1 Mar. 5, 2020

(51) Int. Cl.
*E03C 1/04* (2006.01)

(52) U.S. Cl.
CPC ..... *E03C 1/0404* (2013.01)

(58) Field of Classification Search
CPC ..... Y10T 137/9464; E03C 1/0404; E03C 2001/026; E03C 1/0407
USPC ..... D23/238, 243
See application file for complete search history.

(56) References Cited

U.S. PATENT DOCUMENTS 2,630,082 A 3/1953 Prince
2,790,632 A * 4/1957 Mellette ..... A47L 17/00 239/26
D255,924 S 7/1980 Rosenkranz
5,315,859 A * 5/1994 Schommer ..... E03C 1/08 73/1.25
9,044,130 B2 6/2015 Loisberg
2003/0141480 A1* 7/2003 Green ..... F16K 5/10 251/315.01
2006/0102431 A1 5/2006 Switzer
2010/0139713 A1 6/2010 Averbeck
2013/0019977 A1* 1/2013 Hung ..... E03C 1/04 137/801
2013/0105461 A1 5/2013 Huegerich
2015/0164300 A1 6/2015 Gilreath

FOREIGN PATENT DOCUMENTS

WO WO2010059397 5/2010

* cited by examiner

*Primary Examiner* — Erin Deery

(57) ABSTRACT

A perpetual flow faucet assembly includes an inflow fitting that is fluidly coupled to a fluid source. A ball valve is positioned within the inflow fitting. The ball valve is positionable in an open position thereby facilitating a fluid to flow through the inflow valve. Additionally, the ball valve is positionable in a closed position thereby inhibiting the fluid to flow through the inflow valve. An outflow fitting is fluidly coupled to the inflow fitting such that the outflow fitting receives the fluid from the ball valve when the ball valve is opened. An outflow restrictor is positioned within the outflow fitting for restricting a rate of flow of the fluid through the outflow fitting. A spout is fluidly coupled to the outflow fitting such that the spout receives the fluid when the ball valve is opened thereby directing the fluid into the dipping well.

5 Claims, 3 Drawing Sheets

PERPETUAL FLOW FAUCET ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to faucet devices and more particularly pertains to a new faucet device for reducing water waste in a perpetual flow faucet.

BRIEF SUMMARY OF THE INVENTION

An embodiment of the disclosure meets the needs presented above by generally comprising an inflow fitting that is fluidly coupled to a fluid source. An inflow restrictor is positioned within the inflow fitting for restricting a rate of flow of the fluid through the inflow fitting. A ball valve is positioned within the inflow fitting. The ball valve is positionable in an open position thereby facilitating a fluid to flow through the inflow valve. Additionally, the ball valve is positionable in a closed position thereby inhibiting the fluid to flow through the inflow valve. An outflow fitting is fluidly coupled to the inflow fitting such that the outflow fitting receives the fluid from the ball valve when the ball valve is opened. An outflow restrictor is positioned within the outflow fitting for restricting a rate of flow of the fluid through the outflow fitting. A spout is fluidly coupled to the outflow fitting such that the spout receives the fluid when the ball valve is opened thereby directing the fluid into the dipping well.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
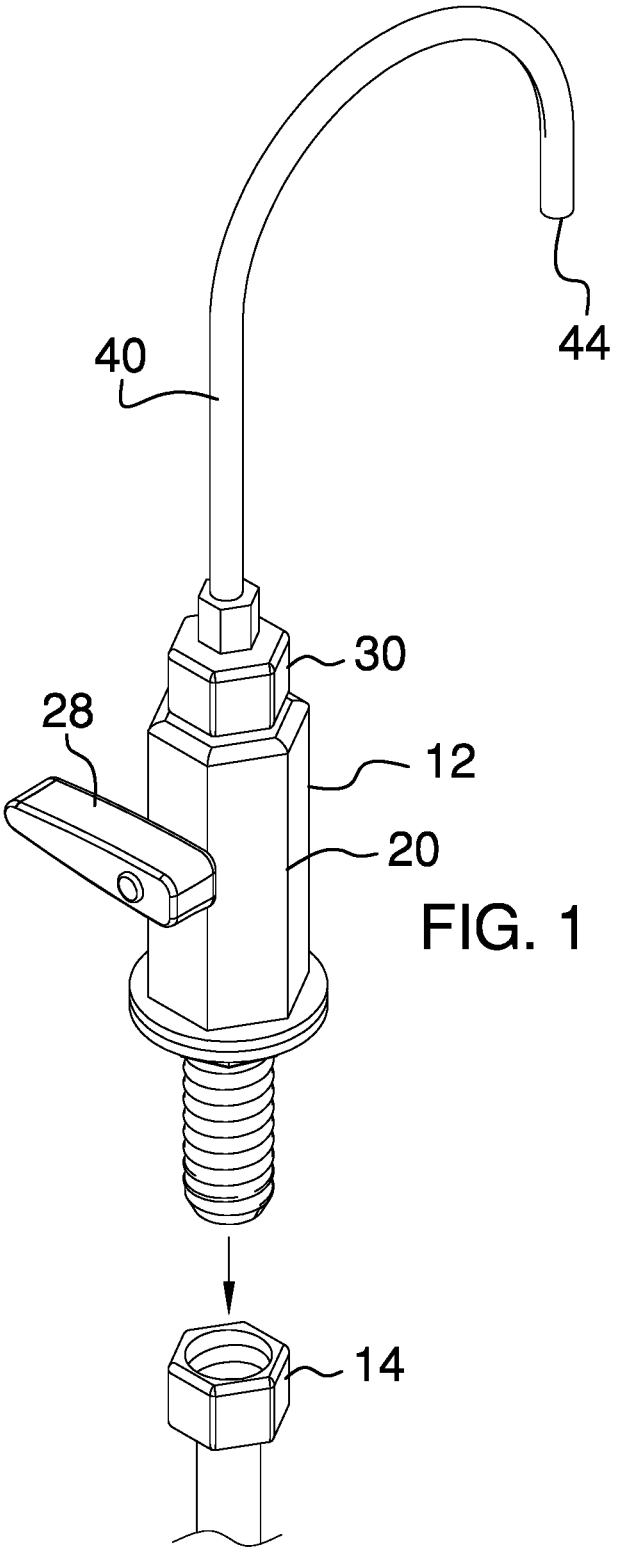
FIG. 1 is a perspective view of a perpetual flow faucet assembly according to an embodiment of the disclosure.
Figure 2:
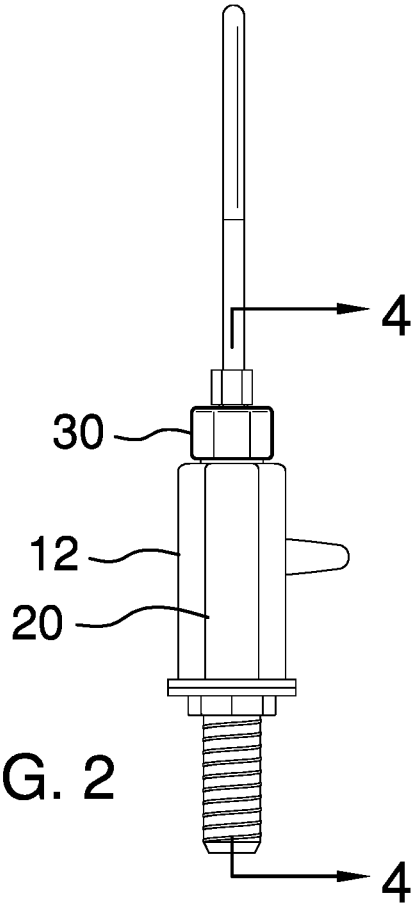
FIG. 2 is a back view of an embodiment of the disclosure.
Figure 3:
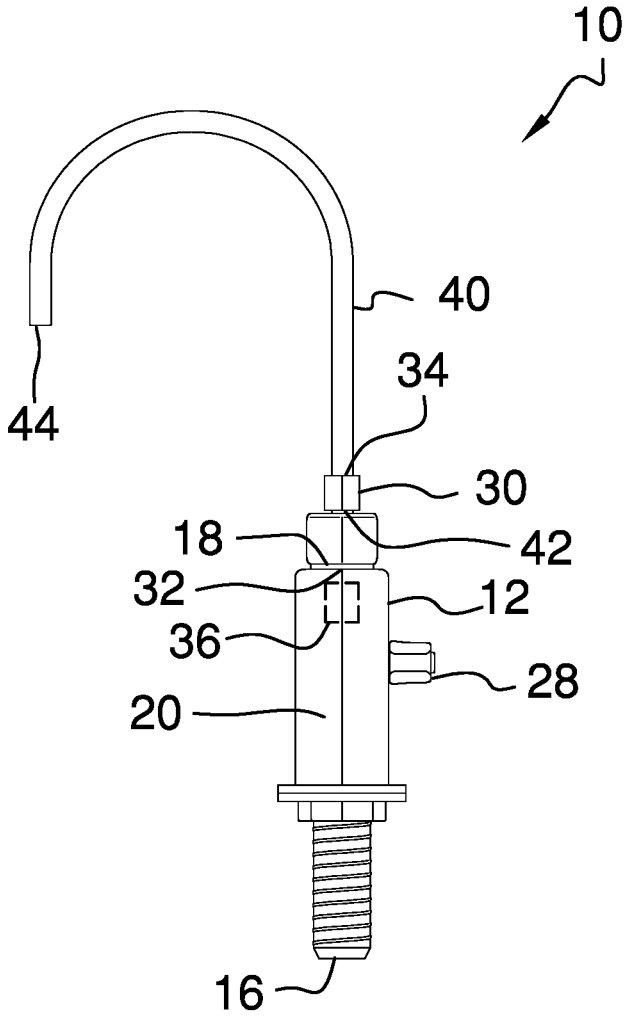
FIG. 3 is a right side phantom view of an embodiment of the disclosure.
Figure 4:
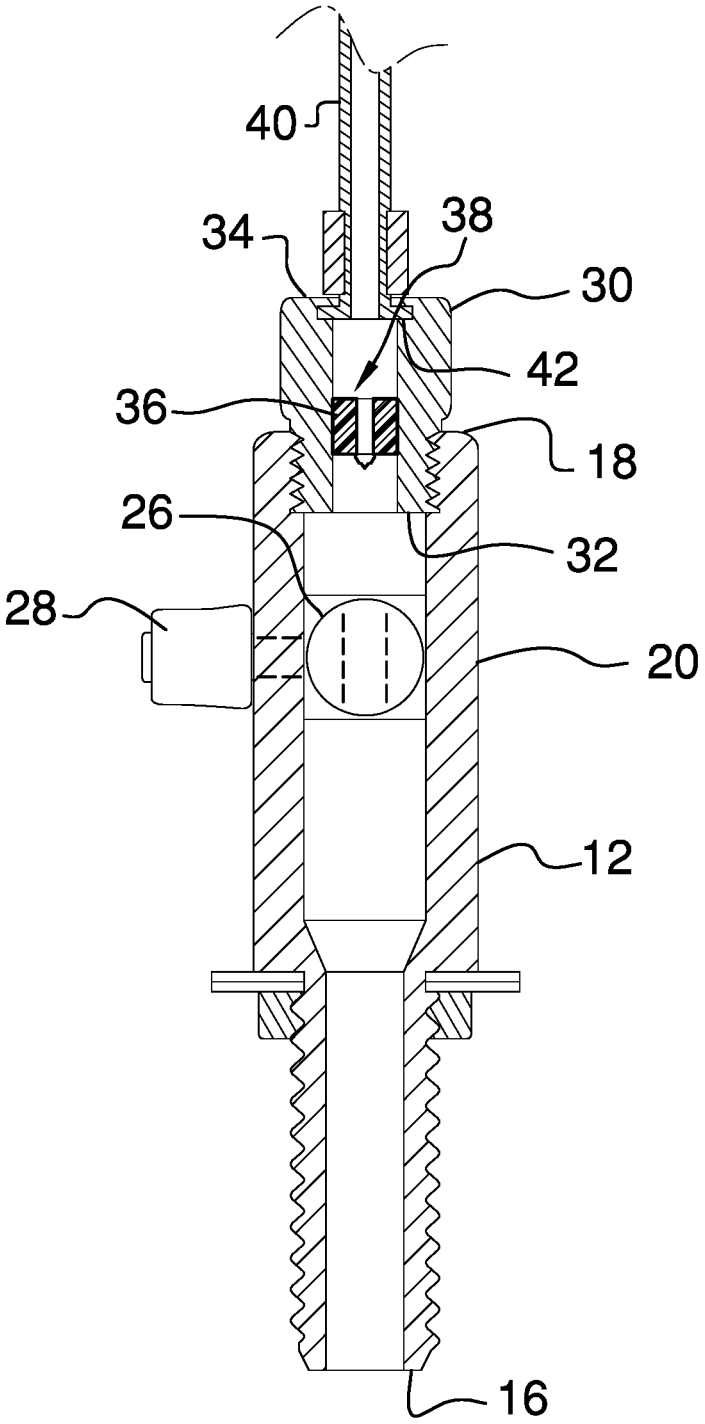
FIG. 4 is a cross sectional view taken along lie 4-4 of FIG. 2 of an embodiment of the disclosure.

With reference now to the drawings, and in particular to FIGS. 1 through 4 thereof, a new faucet device embodying the principles and concepts of an embodiment of the disclosure and generally designated by the reference numeral 10 will be described.

As best illustrated in FIGS. 1 through 4, the perpetual flow faucet assembly 10 generally comprises an inflow fitting 12 that is fluidly coupled to a fluid source 14, such as a water line or the like. The inflow fitting 12 has an inlet 16, an outlet 18 and an outer wall 20 extending therebetween. The inflow fitting 12 is hollow and the inflow fitting 12 is coupled to a dipping well in a restaurant, bar or other food service business. Moreover, the inflow fitting 12 may be a brass water fitting of any conventional design with respect to perpetual flow faucets on dipping wells.

A ball valve 26 is provided and the ball valve 26 is rotatably positioned within the inflow fitting 12. The ball valve 26 is positionable in an open position thereby facilitating a fluid to flow through the inflow fitting 12. Additionally, the ball valve 26 is positionable in a closed position thereby inhibiting the fluid to flow through the inflow fitting 12. The ball valve 26 is positioned between the inlet 16 and the outlet 18, and the ball valve 26 includes a stainless steel ball thereby facilitating the ball valve 26 to resist corrosion from exposure to water. Additionally, the ball valve 26 has a maximum flow rate of approximately 30.0 ounces of water per minute.

A handle 28 is rotatably coupled to the outer wall 20 of the inflow fitting 12. The handle 28 is coupled to the ball valve 26 such that the handle 28 urges the ball valve 26 being the open and closed positions when the handle 28 is manipulated. An outflow fitting 30 is fluidly coupled to the inflow fitting 12 such that the outflow fitting 30 receives the fluid from the ball valve 26 when the ball valve 26 is opened. The outflow fitting 30 has an input 32 and an output 34, and the outflow fitting 30 is hollow. Moreover, the input 32 of the outflow fitting 30 is fluidly coupled to the outlet 18 of the inflow fitting 12. The outflow fitting 30 may be a brass water fitting of any conventional design with respect to perpetual flow faucets on dipping wells.

An outflow restrictor 36 is positioned within the outflow fitting 30 for restricting a rate of flow of the fluid through the outflow fitting 30. The outflow restrictor 36 has a restriction aperture 38 extending therethrough. Additionally, the restriction aperture 38 in the outflow restrictor 36 has a diameter that is less than a diameter of an interior of the outflow fitting 30. The outflow restrictor 36 may have a flow rate that is less than or equal to the flow rate of the inflow restrictor 22. Moreover, the outflow restrictor 36 is removable from the outflow fitting 30 at any time and the inflow restrictor 22 is removable from the inflow fitting 12 at any time.

A spout 40 is fluidly coupled to the outflow fitting 30 such that the spout 40 receives the fluid when the ball valve 26 is opened thereby directing the fluid into the dipping well. The spout 40 has a first end 42 and a second end 44, and the first end 42 is fluidly coupled to the output 34 of the outflow fitting 30. Moreover, the spout 40 is curved between the first 42 and second 44 ends such that the second end 44 is directed downwardly for directing the fluid into the dipping well and the spout 40 is rotatable on the outflow fitting 30.

In use, the inflow fitting 12 is fluidly coupled to the fluid source 14 and the inflow fitting 12 is attached to the dipping well. The handle 28 is manipulated to fully open the ball valve 26 thereby facilitating the fluid to continuously flow out of the spout 40 and into the dipping well. The outflow 36 restrictor restricts the amount of water that can flow through the spout 40 to a maximum of 30.0 ounces per minute when the ball valve 26 is fully opened. In this way the ball valve 26 and the outflow 36 restrictor reduce water waste with respect to perpetual flow faucets on dipping wells. Existing dipper wells commonly employ seat type valves which have a brass seat. Brass can be eroded by water flow thereby causing the seat valve in existing dipper wells to leak after 6 to 8 month of use. The ball valve 26 and the stainless steel construction of the ball valve 26 improve the service life of dipper wells compared to that of seat valves.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A perpetual flow faucet assembly being configured to reduce water consumption, said assembly comprising:

an inflow fitting being fluidly coupled to a fluid source, said inflow fitting being coupled to a dipping well;

a ball valve being positioned within said inflow fitting, said ball valve being positionable in an open position thereby facilitating a fluid to flow through said inflow fitting, said ball valve being positionable in a closed position thereby inhibiting the fluid to flow through said inflow fitting;

an outflow fitting being fluidly coupled to said inflow fitting such that said outflow fitting receives the fluid from said ball valve when said ball valve is opened;

an outflow restrictor for restricting a rate of flow of the fluid through said outflow fitting, said outflow restrictor being positioned entirely within said outflow fitting wherein said outflow restrictor is spaced from said ball valve and said outflow fitting and outflow restrictor are separable jointly from said inflow fitting; and a spout being fluidly coupled to said outflow fitting such that said spout receives the fluid when said ball valve is opened thereby directing the fluid into the dipping well.

2. The assembly according to claim 1, wherein:

said inflow fitting has an inlet, an outlet and an outer wall extending therebetween, said inflow fitting being hollow;

said ball valve is positioned between said inlet and said outlet.

3. The assembly according to claim 1, wherein:

said outflow fitting has an input and an output, said outflow fitting being hollow, said input of said outflow fitting being fluidly coupled to said outlet of said inflow fitting; and said outflow restrictor has a restriction aperture extending therethrough, said restriction aperture having a diameter being less than a diameter of an interior of said outflow fitting.

4. The assembly according to claim 3, wherein said spout has a first end and a second end, said first end being fluidly coupled to said output of said outflow fitting, said spout being curved between said first and second ends such that said second end is directed downwardly for directing the fluid into the dipping well, said spout being rotatable on said outflow fitting.

5. A perpetual flow faucet assembly being configured to reduce water consumption, said assembly comprising:

an inflow fitting being fluidly coupled to a fluid source, said inflow fitting having an inlet, an outlet and an outer wall extending therebetween, said inflow fitting being hollow, said inflow fitting being coupled to a dipping well;

a ball valve being positioned within said inflow fitting, said ball valve being positionable in an open position thereby facilitating a fluid to flow through said inflow fitting, said ball valve being positionable in a closed position thereby inhibiting the fluid to flow through said inflow fitting, said ball valve being positioned between said inlet and said outlet;

a handle being rotatably coupled to said outer wall of said inflow fitting, said handle being coupled to said ball valve such that said handle urges said ball valve being said open and closed positions when said handle is manipulated;

an outflow fitting being fluidly coupled to said inflow fitting such that said outflow fitting receives the fluid from said ball valve when said ball valve is opened, said outflow fitting having an input and an output, said outflow fitting being hollow, said input of said outflow fitting being fluidly coupled to said outlet of said inflow fitting;

an outflow restrictor for restricting a rate of flow of the fluid through said outflow fitting, said outflow restrictor being positioned entirely within said outflow fitting wherein said outflow restrictor is spaced from said ball valve and said outflow fitting and outflow restrictor are separable jointly from said inflow fitting, said outflow restrictor having a restriction aperture extending therethrough, said restriction aperture having a diameter being less than a diameter of an interior of said outflow fitting; and a spout being fluidly coupled to said outflow fitting such that said spout receives the fluid when said ball valve is opened thereby directing the fluid into the dipping well, said spout having a first end and a second end, said first end being fluidly coupled to said output of said outflow fitting, said spout being curved between said first and second ends such that said second end is directed downwardly for directing the fluid into the dipping well, said spout being rotatable on said outflow fitting.

* * * * *